United States Patent [19]

Gehry

[11] 4,067,615

[45] Jan. 10, 1978

[54] ARTICLE OF FURNITURE OR THE LIKE

[76] Inventor: Frank O. Gehry, 2807 Highland Ave., Apt. No. 6, Santa Monica, Calif. 90405

[21] Appl. No.: 253,192

[22] Filed: May 15, 1972

Related U.S. Application Data

[63] Continuation-in-part of Ser. No. 205,900, Dec. 8, 1971, abandoned, which is a continuation-in-part of Ser. No. 73,005, Sept. 17, 1970, abandoned.

[51] Int. Cl.[2] ..... A47C 1/12; A47C 5/00; A47C 7/00

[52] U.S. Cl. ..... 297/445

[58] Field of Search ..... 297/445, 446, 447, 448, 297/449, 452, 454, 457, 458, 459; 161/131–137, 164, 62–64; 156/154

[56] References Cited

U.S. PATENT DOCUMENTS

| | | | |
|---|---|---|---|
| 1,955,833 | 4/1934 | Romanoff | 161/137 X |
| 2,503,933 | 4/1950 | Breuer | 297/445 X |
| 2,575,898 | 11/1951 | Tadinger | 161/137 X |
| 2,640,794 | 6/1953 | Baysen | 161/137 X |
| 2,784,774 | 3/1957 | Andreef | 297/445 X |
| 3,097,016 | 7/1963 | Bigler | 297/445 X |
| 3,131,970 | 5/1964 | McGregor | 297/445 |
| 3,188,693 | 6/1965 | Troyano | 297/445 X |
| 3,371,963 | 3/1968 | Weller | 297/445 |
| 3,483,070 | 12/1969 | Kennedy et al. | 156/154 X |
| 3,592,143 | 7/1971 | Krone | 297/440 |
| 3,604,751 | 9/1971 | Caigan | 297/445 X |

FOREIGN PATENT DOCUMENTS

| | | | |
|---|---|---|---|
| 565,164 | 3/1958 | Belgium | 297/445 |
| 1,654,389 | 12/1970 | Germany | 297/445 |
| 479,529 | 7/1937 | United Kingdom | 297/445 |

*Primary Examiner*—Paul R. Gilliam
*Assistant Examiner*—David Corbin
*Attorney, Agent, or Firm*—Darby & Darby

[57] ABSTRACT

An article of furniture or other similar load bearing structural article comprises a laminate of flat, corrugated cardboard pieces conforming generally to the cross-sectional shape of the article. The plane of each piece is generally parallel to the direction in which the load is predominantly applied with the flutes of adjacent corrugated cardboard pieces extending at right angles to each other. The individual pieces are secured together adhesively and, if desired, support stringers and end pieces may be used for increased rigidity and, thus, improved stability.

8 Claims, 6 Drawing Figures

ARTICLE OF FURNITURE OR THE LIKE

This is a continuation-in-part of U.S. patent application Ser. No. 205,900, filed Dec. 8, 1971 and entitled "Articles of Furniture or the Like", now abandoned which, in turn, is a continuation-in-part of U.S. Pat. application Ser. No. 73,005, filed Sept. 17, 1970 and entitled "Sculptured Cardboard Furniture", now abandoned.

The present invention relates generally to furniture and other similar load bearing articles.

More specifically, the present invention relates to a construction for furniture which is particularly adaptable to mass production techniques, and thus relatively inexpensive, yet which enables the production of long-lasting furniture of unusual designs and textures.

According to the preferred embodiment of the abovementioned U.S. Pat. application Ser. No. 73,005, an article of furniture is made by forming a block of cross-laminated corrugated cardboard sheets, and then simultaneously cutting all of the sheets in the block to "sculpture" the article from the block. The block is cut in such a way that, in the finished product, the planes of the individual corrugated sheets will lie generally parallel to the direction in which the load is applied. Preferably, the corrugations or flutes of adjacent sheets will run alternately parallel and transverse to the direction of this force.

The furniture produced by this technique is inexpensive yet strong and durable; moreover, a wide variety of interesting and attractive shapes can be formed. Perhaps most important from an esthetic point of view is the unusual texture of the finished surface of the article formed by the adjacent cut edges of the cardboard sheets.

Although furniture produced in accordance with the disclosure of application Ser. No. 73,005 has all the attributes desired, there are certain economic disadvantages because of the waste material which may occur in some cases. Moreover, it is impractical to partially assemble such furniture for subsequent reassembly in order to reduce shipping expenses.

The present invention relates to an article which is essentially the same as the article produced by the above-described method, particularly insofar as its appearance is concerned. However, each of the individual pieces is separately cut to the desired shape so that the amount of waste material is substantially reduced. Moreover, the construction is such that the individual parts may be manufactured at one location and shipped to a second location for subsequent assembly. Hence, primarily, the present invention provides economic advantages over the method and article illustrated and described in application Ser. No. 73,005.

Briefly, in accordance with the invention, an article of furniture comprises a laminate of flat corrugated pieces conforming generally to the cross-sectional shape of the article. The pieces are cut from large sheets of material and stacked so that a substantial portion of the exposed surface of the article is defined by the cut edges of the stacked pieces. Means are provided for securing the individual pieces together to provide a strong and stable product.

The invention is described in further detail with reference to the drawings wherein.

Figure 5:
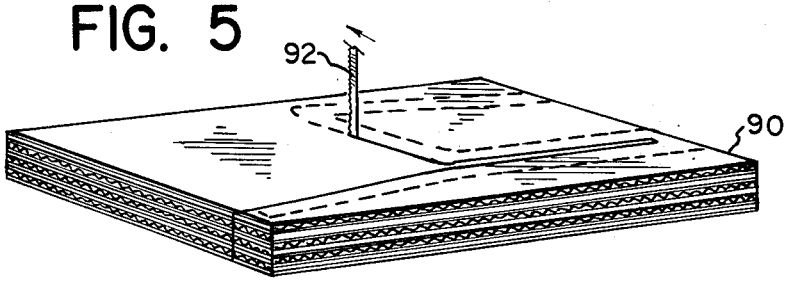
Figure 6:
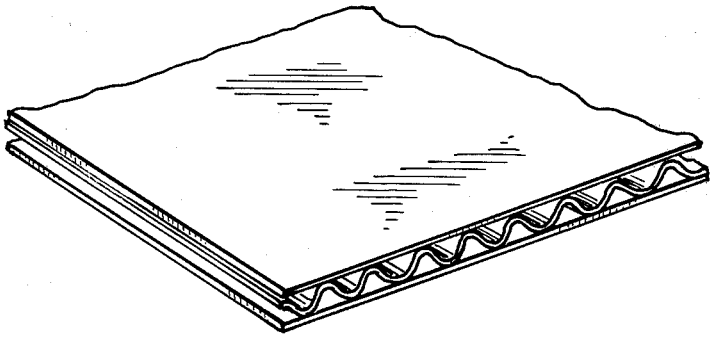

FIG. 5 diagrammatically illustrates the method for making furniture disclosed in application Ser. No. 73,005;

FIG. 6 illustrates a typical piece of double walled corrugated cardboard.

Figure 1:
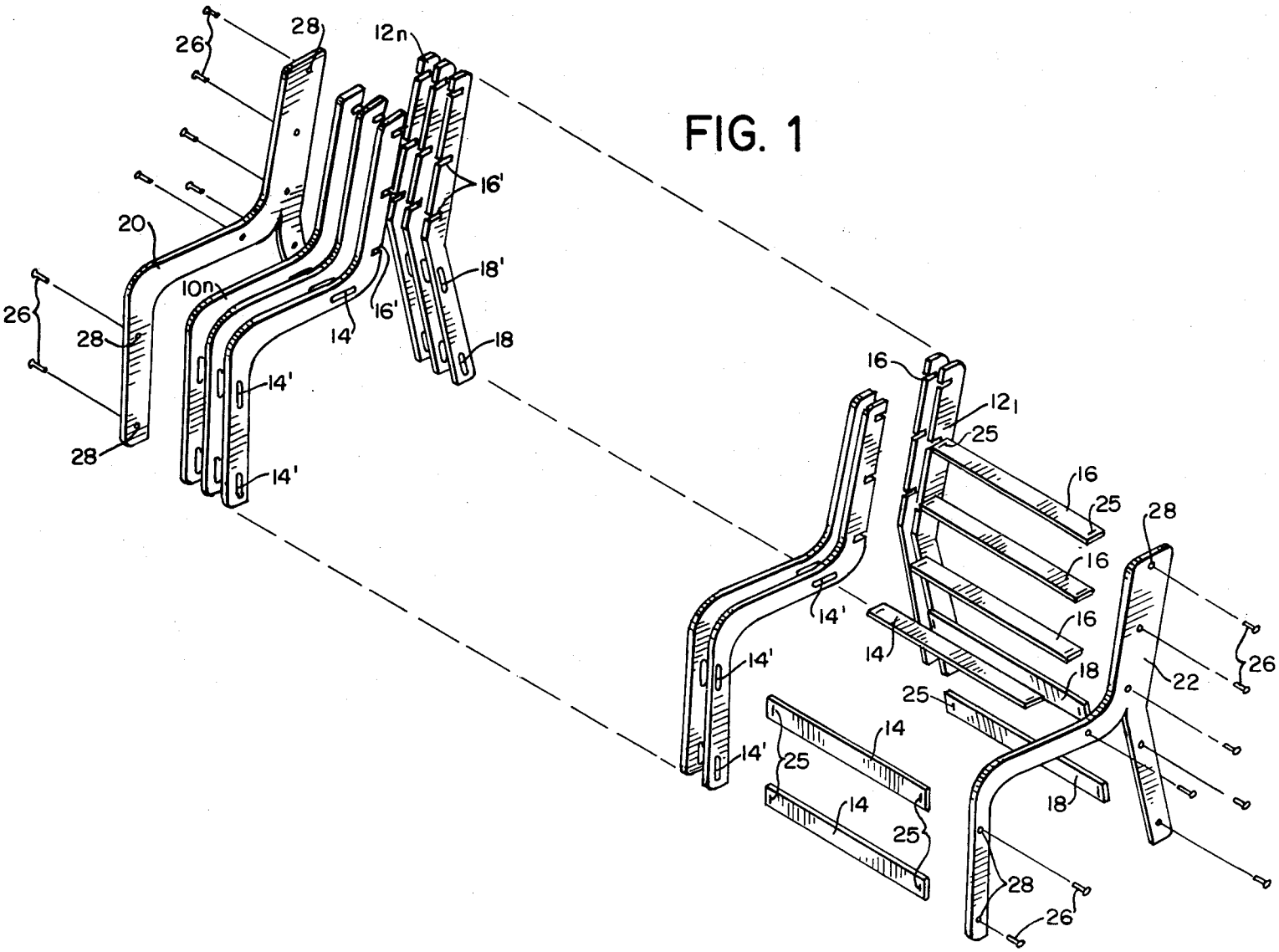
FIG. 1 is an exploded perspective view of a chair manufactured in accordance with a first embodiment of the invention.

The chair illustrated in FIG. 1 includes a curved seat portion 10 and a back portion 12. The seat 10 includes a stack of flat die-cut corrugated cardboard pieces $\mathbf{10}_l$–$\mathbf{10}_n$. The cardboard back 12 similarly comprises a stack of flat die-cut corrugated cardboard pieces $\mathbf{12}_l$–$\mathbf{12}_n$. Each of the pieces 10 and 12 conforms to the cross-sectional shapes of the seat and back portions 10 and 12, respectively. Of course, the particular shape of the article is not a material consideration insofar as the invention is concerned. The chair illustrated in FIGS. 1–3 has been selected as a representative sample of the type of article contemplated by the invention.

The individual cardboard pieces $\mathbf{10}_l$–$\mathbf{10}_n$ and $\mathbf{12}_l$–$\mathbf{12}_n$ are cut so that when they are stacked as shown, the flutes of adjacent pieces run at right angles to each other. In this way the pieces are "cross-laminated" to substantially increase the strength of the finished product.

Three sets of flat rectangular stringers 14, 16 and 18 extend through respective slots 14′, 16′ and 18′ in the various seat and back portions 10 and 12. Slots 16′ extend through both the seat and back pieces whereas slots 14′ and 18′ are located wholly in the seat pieces 10 and back pieces 12, respectively.

A pair of rigid end pieces 20 and 22 are placed against the outer ends of the cardboard pieces $\mathbf{10}_l$, $\mathbf{12}_l$ and $\mathbf{10}_n$, $\mathbf{12}_n$. For appearance, these end pieces 20 and 22 may be made of wood but other materials are also satisfactory. Each of the stringers 14, 16 and 18 includes a pair of palnut inserts 25 at opposite ends for receiving a nail or similar tension fastener. Nails 26 are then inserted through holes 28 in end pieces 20 and 22 into engagement with inserts 25 at both ends of the stringers 14, 16 and 18.

The length of the stringers 14, 16 and 18 depends upon the desired width of the article and, in this embodiment, is selected so that when end pieces 20 and 22 are fastened to the stringers, the cardboard pieces 10 and 12 are compressed. The pressure of these compressed cardboard sheets against the end pieces 20 and 22 will place the stringers 14, 16 and 18 in tension when the article is assembled, as described below.

To assemble the furniture, the cardboard pieces $\mathbf{10}_1$–$\mathbf{10}_n$ and $\mathbf{12}_l$–$\mathbf{12}_n$ are placed in a standard alignment jig (not shown). The stringers 14, 16 and 18 are coated with vinyl glue and inserted through the respective slots 14′, 16′ and 18′. Each of the slots 14′, 16′ and 18′ includes small notches 30 at each side of the slot to form a space running through the entire article which serves as a glue gutter. The glue will also pass to some extent through the individual flutes of the corrugated cardboard sheets.

A vinyl glue or a hot-melt glue (or any other suitable adhesive) is then applied to the exposed surfaces of the end cardboard sheets $\mathbf{10}_l$, $\mathbf{12}_l$ and $\mathbf{10}_n$, $\mathbf{12}_n$. The end pieces 20 and 22 are placed in position and the tension fasteners 26 are driven through the holes 28 into engagement with inserts 25. The compression of the cardboard sheets and resultant tension of the stringers prior to setting of the glue will result in great rigidity when the adhesive has dried. The finished article may then be sprayed with a combination of wax and flame-proofing composition and then permitted to dry for about 2 hours.

There is obviously great flexibility in the selection of material and techniques required to practice the invention. In a specific embodiment, the cardboard sheets were die-cut from 200 pound double wall corrugated sheets (see FIG. 6). The stringers 14, 16 and 18 were made of ¼ inches fir plywood. The palnut inserts 25 were commercially available devices sold by Barco Aviation. The end pieces 20 and 22 were made of ½ inch Finland birch plywood, and they were formed by pin routing which leaves a smoother finished edge than sawing or die-cutting. It is also contemplated that the end pieces 20 and 22 may be molded from five to seven pound urethane plastic foam.

It is not necessary that the seat 10 and back 12 be formed separately; instead, they may be formed as a unitary piece as in the case of end pieces 20 and 22. When separate seat and back pieces are used, it is advantageous to have stringers extending through slots (such as 16') in contiguous furfaces of both pieces.

The principal purpose of the end pieces 20 and 22 is to protect the outer cardboard pieces $\mathbf{10}_l$, $\mathbf{10}_n$ and $\mathbf{12}_l$, $\mathbf{12}_n$ from damage and possible unraveling. The end pieces also contribute to the stability of the article but in some cases their use may not be required. It is also unnecessary that stringers be used. Instead, the individual pieces 10 and 12 may be adhered together by application of an adhesive to the flat surfaces of the individual pieces.

Figure 2:
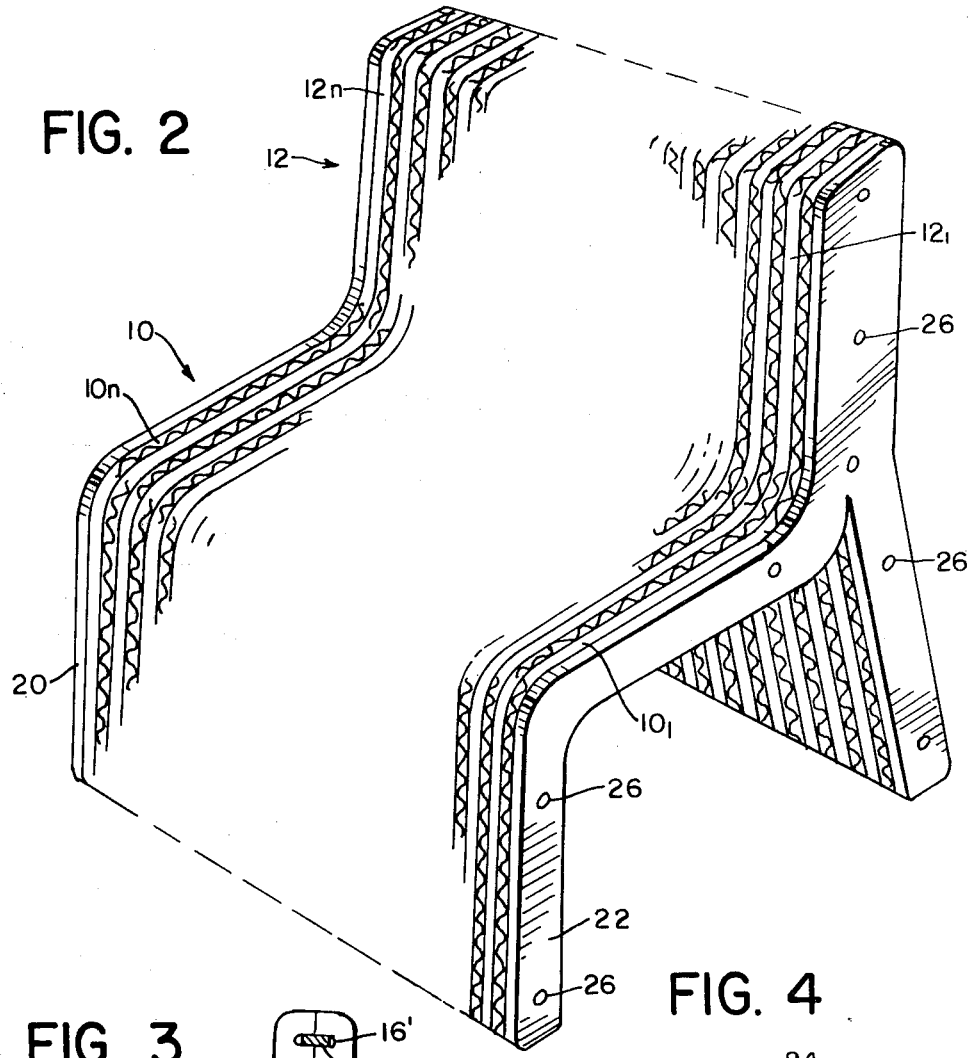
FIG. 2 is a perspective view of the assembled chair shown in FIG. 1.
Figure 3:
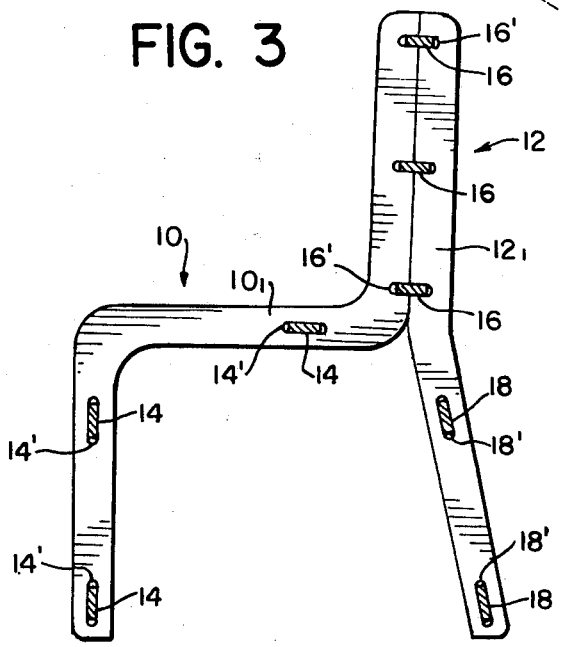
FIG. 3 is a side view of the assembled chair.
Figure 4:
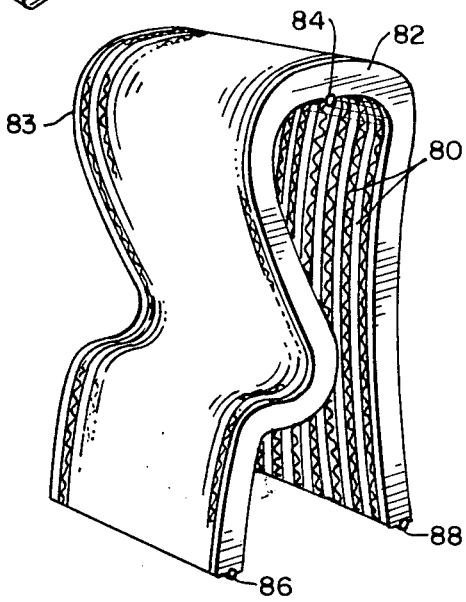
FIG. 4 is a perspective view of a stool according to a second embodiment of the invention.

FIG. 4 illustrates a bar stool fabricated from corrugated cardboard sheets in accordance with the invention but differing in certain respects from the chair illustrated in FIGS. 1–3.

The bar stool of FIG. 4 is made of unitary cardboard pieces 80 rather than separate seat and back portions 10 and 12 as shown in FIG. 1. Two end pieces 82 and 83 (e.g. made of Masonite or fiberboard) are used, but tension fasteners are not inserted into stringers as in the embodiment of FIGS. 1–3. In fact, only three stringers 84, 86 and 88 are used in this particular embodiment. All three stringers may be made of Masonite with stringers 86 and 88 extending beyond the bottom of the lowermost edges of the stool to provide support surfaces on which the entire stool rests.

Since tension fasteners are not used to assemble the bar stool of FIG. 4, the stringers are not under tension in this embodiment. The function of the stringers in this embodiment is merely to bond the pieces together and thus serve as insurance against delamination.

The method of assembly of the stool illustrated in FIG. 4 is similar to that described previously, except that after die-cutting, the individual pieces are coated wth glue. They are then placed in a jig under compression. Stringers 84, 86 and 88 are coated with an adhesive and inserted through suitable channel-forming apertures (not numbered) in the cardboard pieces. Finally, end pieces 82 and 83 are glued to the assembled cardboard pieces. After drying, the article is flame-proofed and waxed.

Gluing the cardboard pieces under compression is desirable when the individual pieces are die-cut since the cutting operation may form crowned or rounded edges. Compressing the stack of cardboard pieces ensures contact between the depressed surfaces of these edges in such a case.

FIG. 5 schematically illustrates the process described in the aforementioned application Ser. No. 73,005. Pursuant to this process, a solid block 90 of laminated sheet material is formed. Preferably, the sheets are cross-laminated, that is, the corrugations of each sheet extend generally at right angles to the corrugations of the adjacent sheet. A cutting edge such as a band saw 92 cuts the desired shape from the entire block. The block thickness may be equal to the desired thickness of the product being formed, or less (as shown in FIG. 5), in which case two or more blocks are cut and laminated together.

Where load-bearing articles of furniture are to be produced, the relationship of the cutting edge and the block should ordinarily be such that the pieces of the finished article will be vertically arrayed when the article is used. Although the process of FIG. 5 appears to be generally less practical than the preferred embodiment in which the individual pieces are die-cut separately and then subsequently laminated together, this process may still have substantial utility in certain situations. For example, where cross-sections of the article would vary in size (for example in a tapered or conical construction), the process of FIG. 5 may prove to be more economical than die-cutting individual pieces which would vary in size.

The specific construction and/or material of the corrugated pieces is not critical. In the preferred embodiment of the invention, standard double-walled corrugated paperboard is used, but other equivalent materials may also be used. For example, single wall corrugated cardboard (or any other commercially available cardboard) may be used. A corrugated plastic material can be substituted for the paper product if this should be convenient or desirable for any reason. The term "corrugated" is also not intended to apply any specific limitation as to the construction of the flutes of the product.

What is claimed is:

1. An article of furniture comprising a plurality of flat pieces, each of said pieces including a multiplicity of parallel flutes, said pieces being cut to conform in shape to a cross section through the furniture, the flutes of each of said pieces extending in a preselected relationship with respect to the flutes of other ones of said pieces, with the edges of each piece being defined by sectional slices through said flutes, means for securing said pieces together to form a laminate, the width of said laminate comprising substantially the full width of the article of furniture, the surfaces of the article of further other than its ends being defined by the exposed edges of said flat pieces, at least one of the surfaces formed by the exposed edges of said corrugated pieces being curved.

2. An article of furniture according to claim 1, wherein the assembled stack of corrugated pieces forms a continuous tube-like surface.

3. An article of furniture comprising a plurality of flat vertical pieces, each of said pieces including a multiplicity of parallel flutes with the edges of each piece being defined by sectional slices through said parallel flutes, the flutes of each piece being perpendicular to the flutes of adjacent pieces, longitudinal strengthening members transverse to said pieces and extending from end to end across the article of furniture, each of said strengthening members passing through openings in said pieces, means for securing said pieces together to form a laminate, the width of said laminate comprising substantially the full width of the article of furniture, the surfaces of the article of furniture other than its ends being defined by the exposed edges of said flat pieces, and solid end pieces conforming to the cross-sectional shape of the article of furniture secured to the ends of said laminate.

4. An article of furniture according to claim 3, wherein said corrugated pieces are shaped to form at least one cantilevered load-bearing limb which is flexible upon application of a load thereto.

5. An article of furniture according to claim 4, wherein said corrugated pieces are shaped to form a sinuous springlike article.

6. An article of furniture comprising a plurality of flat pieces, each of said pieces including a multiplicity of parallel flutes, said pieces being cut to conform in shape to a cross section through the furniture, the flutes of each piece extending at right angles to the flutes of the adjacent piece, with the edges of each piece being defined by sectional slices through said flutes, means for securing said pieces together to form a laminate, the width of said laminate comprising substantially the full width of the article of furniture, the surfaces of the article of furniture other than its ends being defined by the exposed edges of said flat pieces.

7. An article of furniture comprising a plurality of flat pieces, each of said pieces including a multiplicity of parallel flutes, said pieces being cut to conform in shape to a cross section through the furniture, the flutes of each of said pieces extending in a preselected relationship with respect to the flutes of other ones of said pieces, with the edges of each piece being defined by sectional slices through said flutes, means for securing said pieces together to form a laminate, the width of said laminate comprising substantially the full width of the article of furniture, the surfaces of the article of furniture other than its ends being defined by the exposed edges of said flat pieces, and rigid end pieces at the respective ends of the article of furniture.

8. An article of furniture according to claim 7, wherein spaced supporting members extend through said corrugated pieces across the article of furniture.

* * * * *